United States Patent [19]

Cole et al.

[11] 4,112,800

[45] * Sep. 12, 1978

[54] APPARATUS FOR SUCCESSIVELY DISPENSING FROM A CAN OF A JELLIED PRODUCT SLICES OF A CROSS SECTIONAL AREA LESS THAN THAT OF THE CAN

[76] Inventors: Lawrence S. Cole; Ruth J. Cole, both of High Street, North Carver, Mass. 02355; Rigo Facchini, North Plymouth, Mass. 02360

[ * ] Notice: The portion of the term of this patent subsequent to , has been disclaimed.

[21] Appl. No.: 811,476

[22] Filed: Jun. 30, 1977

Related U.S. Application Data

[63] Continuation of Ser. No. 672,870, Apr. 2, 1976, abandoned.

[51] Int. Cl.[2] ..... B26D 4/80; B26D 7/04

[52] U.S. Cl. ..... 83/411 A; 83/408; 83/437; 83/161

[58] Field of Search ..... 83/411 A, 411 R, 408, 83/437, 150, 161, 467

[56] References Cited

U.S. PATENT DOCUMENTS

| | | | |
|---|---|---|---|
| 1,407,759 | 2/1922 | Knox | 83/411 A |
| 1,752,067 | 3/1930 | Crankshaw | 83/411 A |
| 3,979,982 | 9/1976 | Cole | 83/437 |

*Primary Examiner*—Donald R. Schran

[57] ABSTRACT

A dispenser for use with a can of a jellied product has a holder to support an opened can in such an inclined position that with its open end downwardly its contents slide against a fixed retaining plate. An insert divides the contents into longitudinal sections. Means are provided to rotate the can and the retaining plate has an open ended slot extending from the center thereof and a blade extending forwardly and upwardly from the rear edge of its slot, the blade severing the sections as the can is rotated and forcing the sliced sections through the slot. Means are also provided to force the can holder into a position in which the rim at the closed end of the can is gripped by the can rotating means which may be a can opener, either manually or motor operated.

19 Claims, 11 Drawing Figures

Fig. 5
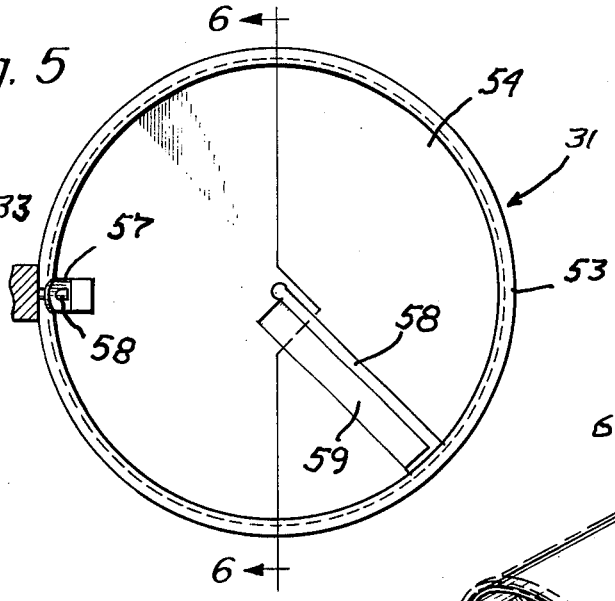
Fig. 7
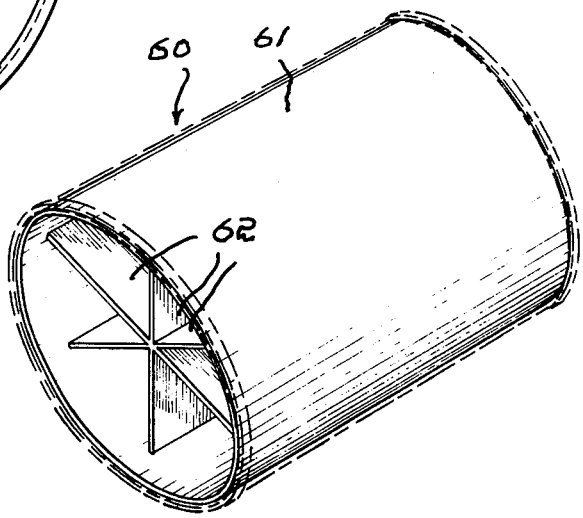
Fig. 6
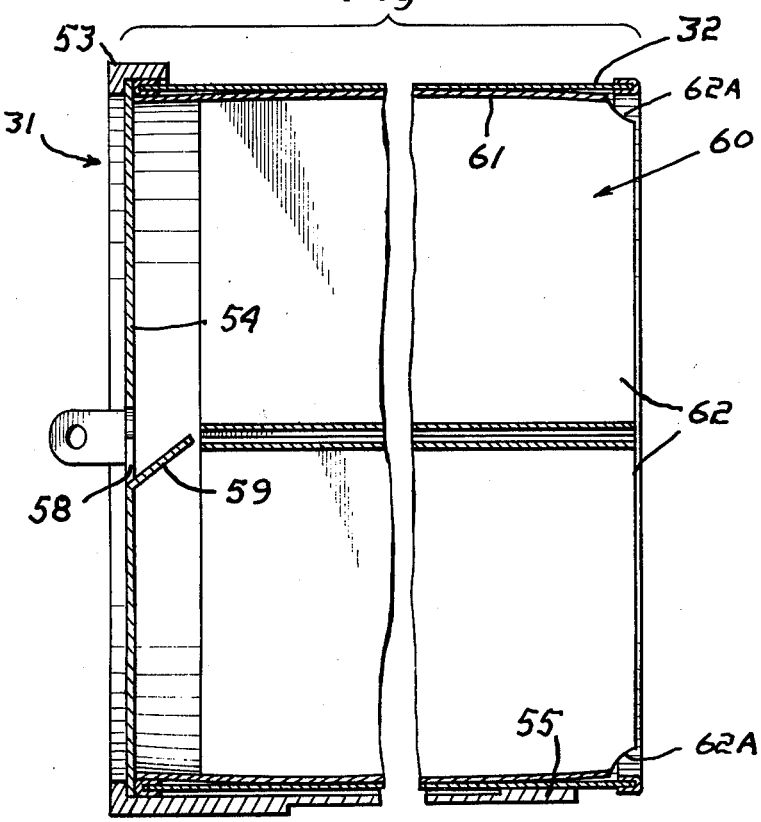
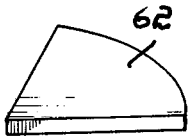
Fig. 8

10

65
75
76
68
80
45A
67
42A
66
10
39A
71
72
69
70
78
37A
40A 75
76
65

37A
42A
45A
67
66
79
80
68
71
69
40A
77
72
38A
78

76

80
37A
68
75
41
67
45A
65
73
79
74
71
77
72
78
70

APPARATUS FOR SUCCESSIVELY DISPENSING FROM A CAN OF A JELLIED PRODUCT SLICES OF A CROSS SECTIONAL AREA LESS THAN THAT OF THE CAN

This is a continuation of application Ser. No. 672,870, filed Apr. 2, 1976, now abandoned.

RELATED APPLICATION

Ser. No. 508,144, filed Sept. 23, 1974 now Pat. No. 3,979,982.

BACKGROUND REFERENCES

U.S. Pat. No. 2,264,937, U.S. Pat. No. 2,603,868, U.S. Pat. No. 2,810,195.

BACKGROUND OF THE INVENTION

Jellied food products such, for example, as cranberry sauce, are sold in large containers and for most uses, must be served in small slices of desired shapes.

In the above referred to application, an opened can containing such a food product is supported in an inclined position with its open end downwardly and with a stop positioned to limit the extent to which the product can slide forwardly from the can in response to gravity. A cutter is movable across the open end of the can between it and the stop to slice free the exposed product. An insert is also disclosed that when forced into the open can, divides the can contents into longitudinal sections with each slice then containing a plurality of sections.

While a dispenser in accordance with said application is well adapted for use where the diameter of the cans is small, so called one pound cans, for example, they are not so well suited for use where as in the case of No. 10 cans, the cross sectional area of the product is too large to dispense in response to a cross sectional severance whether or not the cross sectional area is predivided into longitudinal sections.

THE PRESENT INVENTION

The general objective of the present invention is to provide a dispenser for use with cans of jellied food products in which the cross sectional area of the contents is too large to permit a single layer to be an individual serving and hence must be subdivided and operable to deliver sections of a layer that are of desired sizes and shapes without discharging those of an entire layer at the same time.

In accordance with the invention, this general objective is attained with apparatus including a dispenser provided with a holder for a can that has been opened at one end and positioned so that the open end is so downwardly disposed as to ensure movement of the contents by gravity against a fixed retaining plate. An insert in the can divides the contents into lengthwise sections and means are provided to rotate the can relative to the retaining plate. The retaining plate has an open-ended slot extending outwardly from its center and a blade extending upwardly and forwardly over the slot to slice the product as the can turns and force the sliced sections successively through the slot.

Another objective of the invention is to provide that the can held by the can holder may have its upwardly disposed closed end wall punctured and cut free as an incident to the dispensing operation, an objective attained by utilizing a can opener as the means by which the can is rotated and another objective of the invention is to have the can rotated without cutting or puncturing the closed end wall, an objective attained with the can rotating means provided with a rotatable member engageable with the can to hold it in engagement with the rotatable drive member of the can rotating means.

Yet another objective of the invention is to provide means for positioning the upwardly disposed, closed can end, whether or not it is to be rotated by means of a can opener, so as to be so clamped by the can rotating means as to be positively turned, an objective attained by supporting the can holder for movement towards or away from the can rotating means and providing a manually rotated cam to force the can holder into a position in which the rim at that end can be so gripped.

Other objectives of the invention will be apparent from the appended specification and claims.

BRIEF DESCRIPTION OF THE DRAWINGS

In the accompanying drawings, preferred embodiments of the invention are illustrated with FIG. 1 is a view of a dispenser in accordance with one embodiment of the invention as seen from one side thereof;

FIG. 5 is an outside view of the bottom of the can seat;

FIG. 6 is a lengthwise section of the can seat, a can, and a can insert, the view being broken away to foreshorten the figure;

FIG. 7 is a perspective view of a can insert by which the contents are divided lengthwise into sections;

FIG. 8 is a view of the dispensed products;

THE PREFERRED EMBODIMENTS OF THE INVENTION

In the embodiment of the invention illustrated by FIGS. 1–8, the dispenser generally indicated at 20 is connected to a base 21 by a pivotal connection, generally indicated at 22.

Figure 1:
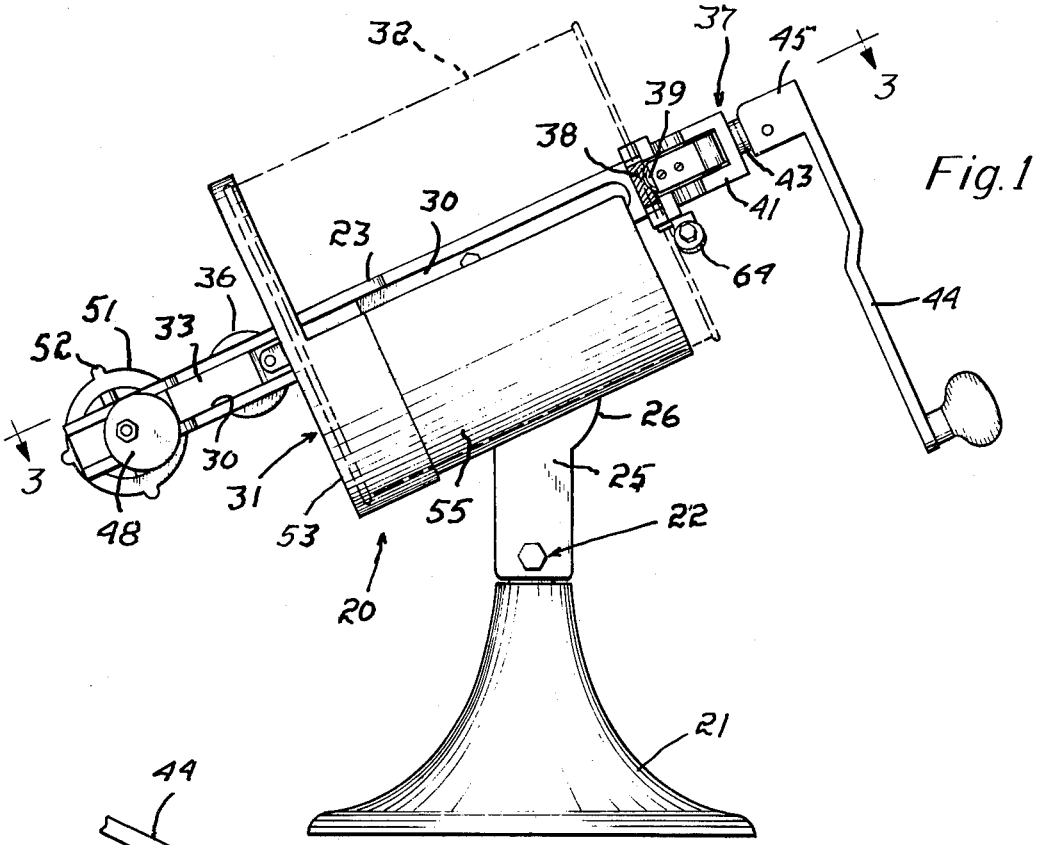
Figure 2:
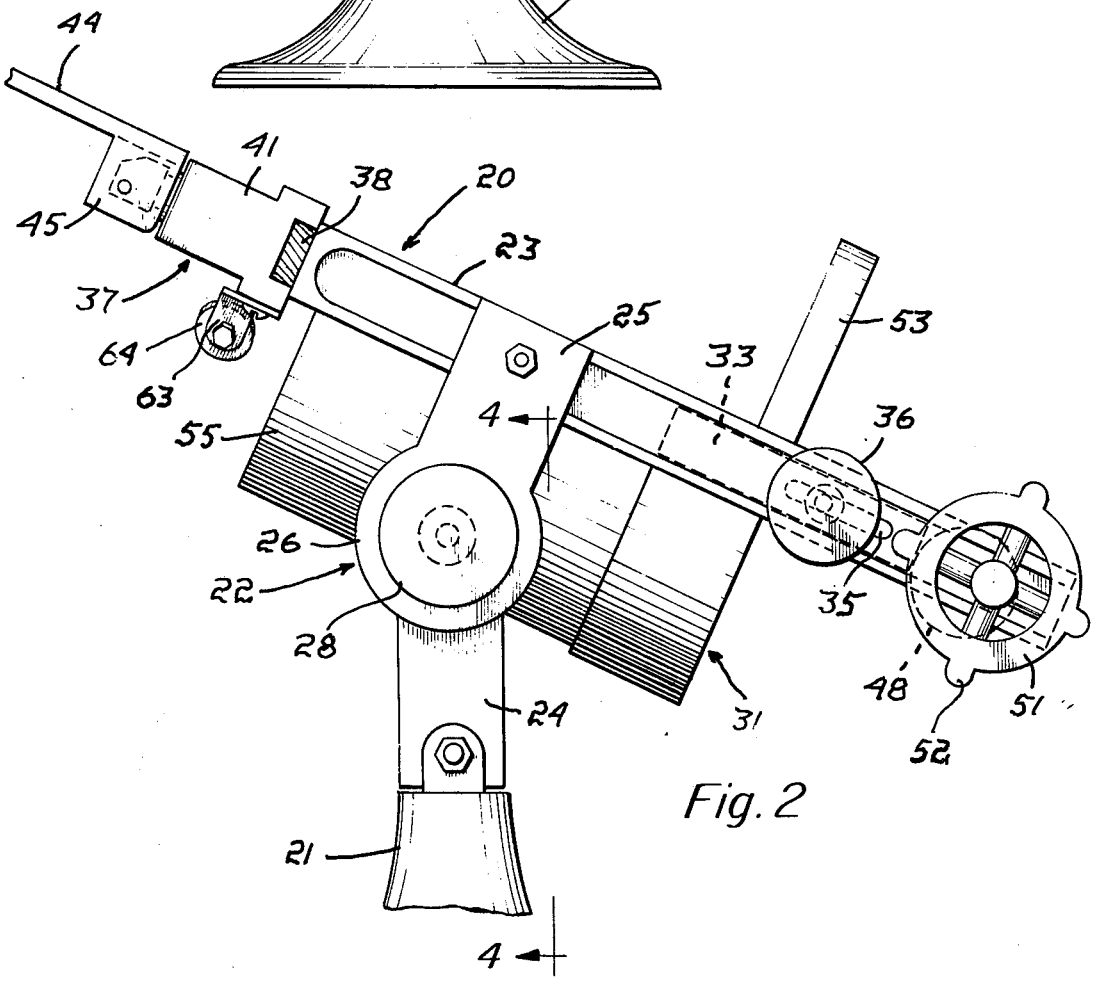
FIG. 2 is a view, on an increase in scale, of the dispenser as seen from the other side thereof.
Figures 3, 4:
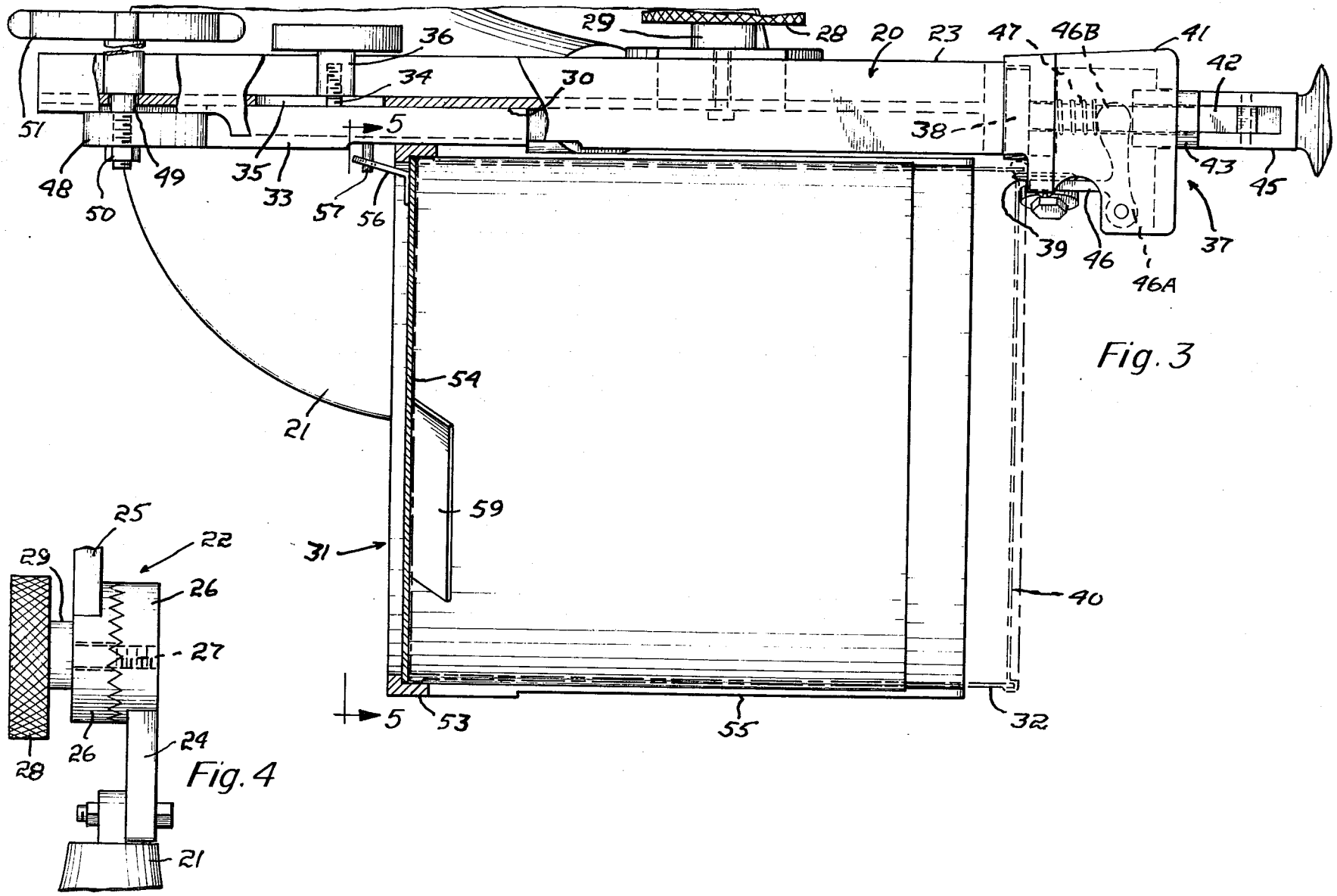
FIG. 3 is a partly sectioned plan view of the dispenser on a further increase in scale.
FIG. 4 is a section taken approximately along the indicated lines 4—4 of FIG. 2.

The dispenser includes a bar 23 and the connection 22, see FIGS. 2 and 4, has a first arm 24 attached to the base 21 and a second arm 25 attached to the bar 23 centrally thereof. The arms 24 and 25 have circular heads 26 interconnected by a transverse clamping pivot 27 with their proximate faces provided with interengageable, radial teeth. The pivot 27 has a knurled knob 28 and a boss 29 at one end, the boss bearing against one head 26 and the pivot threaded into the other head so that the angle of the dispenser 20 relative to the surface on which the base 21 rests may be adjusted between loading and dispensing positions and the adjusted angle positively maintained when the clamping pivot 27 is suitably tightened.

The bar 23 has a lengthwise slideway 30 in one side. A holder, generally indicated at 31, for a can 32 includes a slide 33 confined in the slideway 30 for limited lengthwise travel by means of a threaded stud 34 extending through a slot 35 in the bar 23 with a retainer 36 threaded thereon.

A can rotating unit, generally indicated at 37, is mounted on one end of the bar 23 and when the bar is positioned for dispensing use, that end of the bar is upwardly inclined. In the loading position of the dispenser, the bar 23 is desirably nearly level or oppositely inclined.

The unit 37 includes a rotatable drive member 38 engageable with the rim portion of the side wall of a can 32 and a member 39 operable to so hold the rim against the drive member 38 that the can 32 turns.

In the disclosed embodiments of the invention, the unit 37 embodies can opener features and is desirably of the type manufactured by Edlund Co., Burlington, Vt., for restaurant and like uses as it includes the bar 23 and is readily modified as required by the present invention, one modification being that the member 39 is a rotatable disc engageable with the end wall 40 of the can 32 and the rim without cutting the end wall thus keeping the contents enclosed making the dispenser well adapted for self service use.

A desirable feature of such a can opener is that the member 39 has two positions relative to the drive member 38. In the first, the member 39 is spaced therefrom so that the rim of the can may be freely entered between them and a second position in which the member 39 is so moved towards the drive member 38 that the rim is securely held between them. To that end and as may be seen in FIG. 3, the drive member 38 is within a mount 41 and attached to the bar 23 fixed on a shaft 42 extending freely through a slide 43. A crank 44 has a yoke 45 pivotally connected to the outer exposed end of the shaft 42 and in engagement with the outer end of the slide 43.

The member 39 is attached to a T-shaped carrier 46 having one arm 46A pivotally connected to the mount 41 and its arm 46B in the form of a fork straddling the shaft 42 between the slide 43 and a spring 47 backed by the drive member 38. If the crank 44 is pivoted from its full line operative position into its dotted line position, the yoke 45 functions as a cam and forces the slide 43 against the opposition of the spring 47 and pivoting the carrier 46 thus to shift the member 39 from its second operative position into its first position.

The slide 33 of the can holder 31 rests on the periphery of a cam 48 threaded on a pivot 49 and secured by a lock nut 50. The pivot 49 extends transversely through the bar 23 and is provided with a knob 51 desirably having radial arms 52 to provide the operator with additional mechanical advantage in turning the cam 48 to advance the slide and the can holder 31 towards the can turning unit 37.

The can holder 31 includes a circular seat 53 for a removable circular plate 54 and the open end of the can 32 with the contents of the can resting on the plate 54. The seat 53 also includes an arcuate support 55 on which one side of the can 32 rests. The plate 54 has an anchor 56 detachably caught by a pin 57 on the slide 33 as a means of preventing the plate 54 from turning with the can 32. The plate 54, see FIGS. 3, 5, and 7, has a substantially radial, open ended slot 58 extending through its periphery from the center thereof and, at one edge of the slot 58, in operation, its trailing edge, there is a forwardly and upwardly inclined blade 59 of substantially the same length. The height of the cutting edge of the blade 59 relative to the plate 54 determines the thickness of the slices and the incline of the blade serves to force the cut slices through the slot 58. By way of example and not of limitation, the slot 58 is ½ inch in width and the cutting edge of the blade is spaced a like distance from the plate 59 and the blade is an integral part of the plate.

In practice, the cover of the can 32 is removed and an insert, generally indicated at 60, see FIGS. 6 and 7, is forced therein. The insert 60 is shown as consisting of a cylindrical shell 61 dimensioned to be a friction fit in the can 32 and seat against its closed end, and provided with radial blades 62 joined at its axis. The ends of the blades 62 that seat against the closed end of the can 32 are shown relieved at their outer ends as at 62A for reasons subsequently to be explained. The other ends of the blade 62 terminate short of the other end of the shell 61 a distance such as to ensure that the slicing blade 59 is not engaged as the can 32 turns. It will be appreciated that the contents of the can 32 are divided by the insert 60 into longitudinal sections.

In practice, the bar 23 is tilted (either relative to the base 21 or by tilting the apparatus as a unit) so that the open end of the can 32 with the insert seated thereon may be seated in the can holder 31. With the apparatus positioned for use, the inclination of the bar 23 is such that gravity will cause the sectioned product to slide in the can 32 and seat against the plate 54. With the crank 44 inoperatively positioned, the cam 48 is turned to advance the slide 33 thus to force the can 32 in the can holder 31 upwardly until the rim is between the members 38 and 39 and its closed end is engaged by the member 39 which is now in its first position. With a receiver, not shown, below the can holder 31 and the crank 44 returned to its operative position, the can 32 is so securely held that when the crank 44 is turned, the can 32 is turned advancing its longitudinally divided sections against the blade 59 so that cut sections 62 are successively discharged through the slot 58 and such sections advance under the influence of gravity to again seat against the fixed plate 54.

In accordance with the invention, the mount 41 is provided with an arm 63 disposed radially with respect to the axis of the can 32 supporting a hold down roller 64 on the trailing side of the member 39 for engagement with the wall 40 close to or in contact with the rim of the can.

Figure 9:
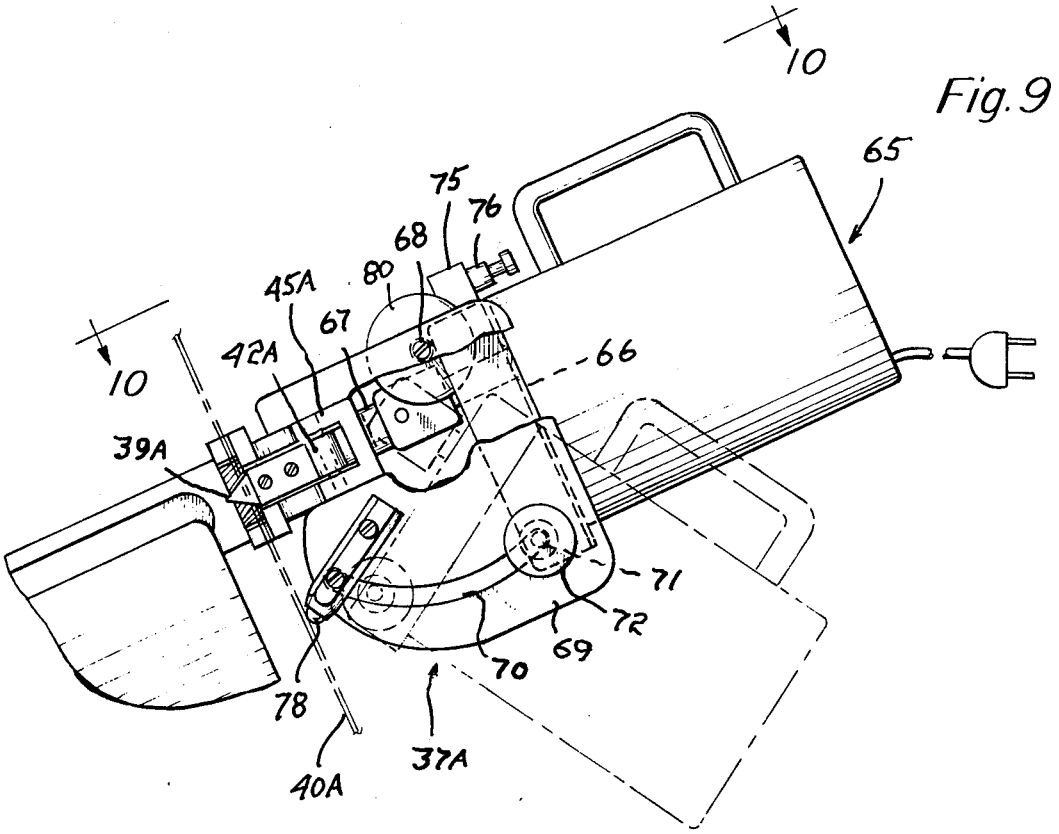
FIG. 9 is a partial side elevation of another embodiment of the invention.
Figure 10:
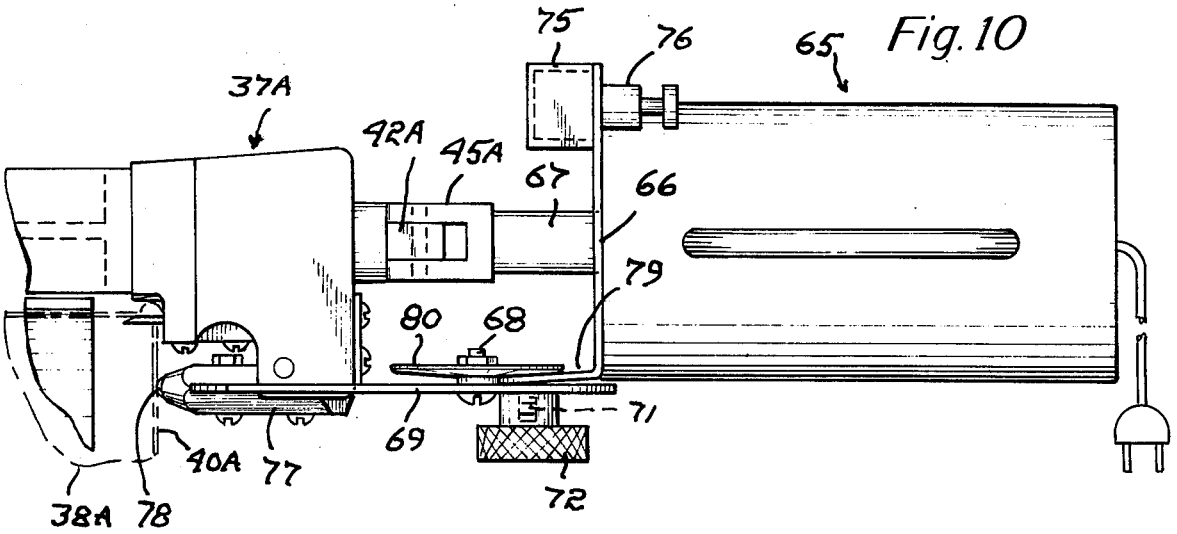
FIG. 10 is a top plan view thereof.
Figure 11:
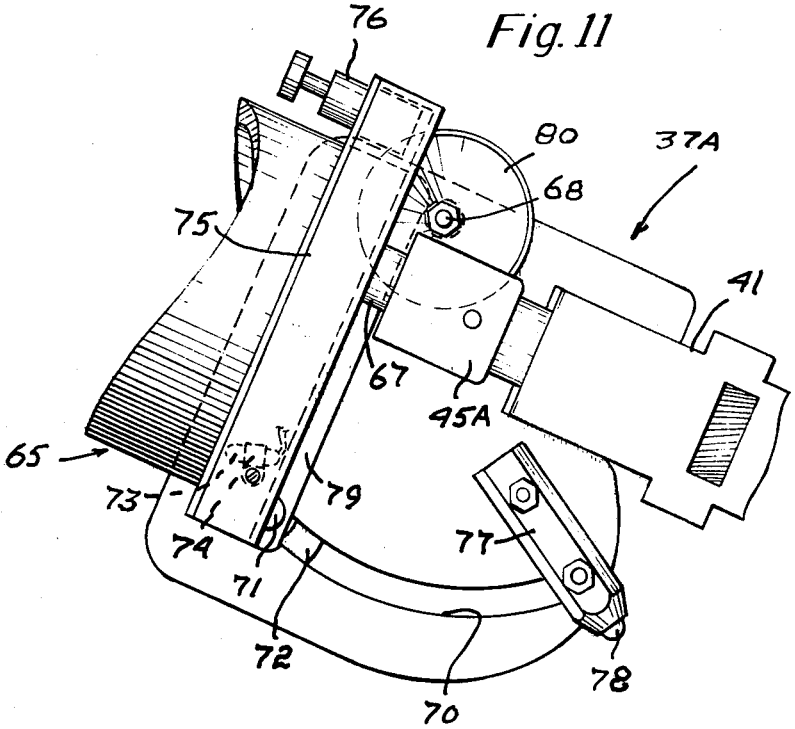
FIG. 11 is a fragmentary view of the side opposite that shown in FIG. 9.

The embodiment of the invention illustrated by FIGS. 9 and 10 is similar to that just described except that the can turning unit 37A in the dispenser is operated by an electric motor 65 instead of the crank 44 and is a can opener as the member 39 is replaced by a blade 39 operable to pierce the end wall of a can and to cut that wall free as the can is turned.

To that end, the motor 65 is mounted on a bracket 66 with its drive shaft 67 provided with a yoke 45A pivotally connected to the shaft 42A of the unit 37A. The bracket 66 is connected by a pivot 68 to a plate 69 attached to the mount 41 and having an arcuate slot 70 concentric with the pivot 68. The bracket 66 has a threaded stud 71 extending through the slot 70 and provided with a clamping nut 72. With the stud 71 at the upper end of the slot 70, the motor 65 is so positioned that it may be safely operated, the blade 39A then being in its second position. When the stud 71 is at the bottom of the slot 70, the blade 39A is in its first position and in order to prevent the motor from then being operated, its circuit includes a switch 73 that is desirably a mercury switch and is positioned to open if the stud 71 is not in its uppermost position. To that end, the switch 73 is mounted on an adjustable bracket 74 so that the switch 73 may be positioned as required by the inclination of the base 23 selected for the operating position of the dispenser.

The plate 69 is provided with an arm 75 having an anti-friction member 76 engageable with the end wall 40 of the can being turned substantially at its junction with the rim, the anti-friction member 76 being shown as a ball bearing.

In order to steady the drive, the bracket 66 includes a flange 77 adapted to frictionally engage and seat behind a retainer 78 shown as carried by the pivot 68.

We claim:

1. Apparatus for successively dispensing slices of a jellied product from a can that is open at one end, the slices of a cross sectional area less than that of the can, said apparatus comprising a dispenser including a can holder disposed and dimensioned to hold said can open end downwardly thus ensuring movement of the product toward its open end by gravity and so that it may be rotated, an insert in said can frictionally held thereby so that the can and the insert turn together and become parts of a unit, said insert including walls spaced and arranged to divide its contents into a plurality of lengthwise sections, a fixed retaining plate associated with said holder engageable by the product as a stop to prevent such movement, said walls terminating above said plate, said plate having a slot extending outwardly from the center thereof and including a forwardly and upwardly inclined blade at the rear of said slot with the cutting edge of the blade close to the lower ends of the walls of the insert and operable as the can is rotated to sever the sections successively and to force them through said slot, and means attached to a part of said unit and operable to effect the rotation thereof in the appropriate direction relative to the blade.

2. The apparatus of claim 1 in which the can rotating means includes a pair of members, one member a rotatable drive member, and means to move one of said members relative to the other from a first relationship into a second relationship in which the can is held in engagement with the drive members, one member then engaging the side wall of the can adjacent the rim at the closed, upper end thereof and the other member engages the can inside said rim.

3. The apparatus of claim 2 in which the member engaging the can, inside the rim, is a rotatable member.

4. The apparatus of claim 2 in which the member engaging the can, inside the rim, is a blade operable, as the can is turned, to cut free the closed end wall of the can after said wall has been punctured thereby.

5. The apparatus of claim 3 and means operable to move the can holder into and out of a position in which the rim of the can is between said pair of members.

6. The apparatus of claim 4 and means operable to move the can holder into and out of a position in which the rim is positioned between said pair of members and the closed end wall of the can is punctured by the member engaging it.

7. The apparatus of claim 6 in which the means moving the can holder includes a cam the turning of which effects said movements.

8. The apparatus of claim 2 in which the can rotating means includes an anti-friction member on the trailing side of the member engaging the can inside the rim thereof.

9. The apparatus of claim 2 in which the means effecting relative movement between the pair of members includes first and second shafts, pivot means interconnecting said shafts, means operable when said shafts are axially aligned to effect said second relationship and when said second shaft is disposed at an angle relative to the first shaft to effect said first relationship, a motor including a bracket pivotally connected to said mount for movement between two positions, one for each relationship, the second shaft connected to said motor.

10. The apparatus of claim 9 in which the motor circuit includes a switch closed when said shafts are aligned and the cam holder is positioned to hold the cam in said downwardly inclined position.

11. The apparatus of claim 10 in which the switch is a mercury switch and an angularly adjustable holder connects said switch to the motor bracket.

12. The apparatus of claim 9 and said bracket and said mount including portions interengageable when said shafts are axially aligned to stabilize the bracket while the motor is operating.

13. The apparatus of claim 1 in which the cam holder includes a circular seat on which the retaining plate rests, the seat is dimensioned to receive the open end of the can and permit the turning thereof and includes a portion against which the side of the can rests as it turns, and means connecting the retaining plate to the holder below said seat.

14. The apparatus of claim 1 in which the insert includes a shell that is a friction fit in the can and includes a plurality of blades the lower ends of which terminate above the lower end of the shell to prevent their contact with the blade of the retaining plate.

15. The apparatus of claim 14 in which the upper ends of the blades of the insert are relieved at their outer ends.

16. The apparatus of claim 1 in which the blade of the retaining plate is an integral part thereof and its length and width are those of the corresponding dimensions of the slot.

17. The apparatus of claim 1 and a base and the dispenser includes a bar, a slidable connection between the can holder and the bar, the can rotating means are connected to one end of the bar, and means at the other end of the bar operable to move the can holder into a position in which the closed end of the can is engageable by the can rotating means.

18. The apparatus of claim 17 in which the bar has a channel extending lengthwise of one side thereof, the can holder includes a slide held therein by said slidable connection, and the means operable to move the can holder includes a cam engageable with said slide and rotatably attached to said bar.

19. The apparatus of claim 17 in which the bar is pivotally connected to the base.

* * * * *